US006154734A

United States Patent [19]

Bailey et al.

[11] Patent Number: 6,154,734

[45] Date of Patent: Nov. 28, 2000

[54] POSTAGE METERING SYSTEM HAVING CURRENCY COMPATIBILITY SECURITY FEATURE

[75] Inventors: William F. Bailey; Craig J. DeFilippo, both of Milford, Conn.

[73] Assignee: Pitney Bowes Inc., Stamford, Conn.

[21] Appl. No.: 09/294,604

[22] Filed: Apr. 19, 1999

[51] Int. Cl.[7] ..... G07B 17/00

[52] U.S. Cl. ..... 705/410; 705/408

[58] Field of Search ..... 705/400, 401, 705/408, 410

[56] References Cited

U.S. PATENT DOCUMENTS

| | | | |
|---|---|---|---|
| 4,858,138 | 8/1989 | Talmadge | 364/464.02 |
| 5,570,465 | 10/1996 | Tsakanikas | 358/1.15 |
| 5,602,742 | 2/1997 | Solondz et al. | 705/410 |
| 5,680,463 | 10/1997 | Windel et al. | 380/51 |
| 5,688,056 | 11/1997 | Peyret | 400/61 |
| 5,799,290 | 8/1998 | Dolan et al. | 705/410 |
| 5,960,418 | 9/1999 | Kelly et al. | 705/408 |

FOREIGN PATENT DOCUMENTS 0 889 443 A2 1/1999 European Pat. Off. .

OTHER PUBLICATIONS

Paris: "The Euro dilemma"; Wall Street & Technology, Jan. 1998, v16, n1, pp. 22–28.

Walmsley: "Are you ready for EMU?"; Banker, Sep. 1998, v148, n871, pp. 30–31.

Trefgarne: "City: City impervious to the hype and the glory George Trefgarne reports on the preparations for Monday's trading in the euro"; Daily Telegraph, Jan. 2, 1999.

"Sterling diapears from the Royal Mail's stamp for Europe"; Sunday Times (united Kingdom, Dec. 13, 1998.

*Primary Examiner*—Edward R. Cosimano

*Attorney, Agent, or Firm*—Steven J. Shapiro; Michael E. Melton

[57] ABSTRACT

A value dispensing system includes a vault that accounts for units of a currency type dispensed by the value dispensing system, the vault including a first identifier that indicates one of different first and second currency types the vault is currently accounting for and a second identifier indicative of whether the vault is pending conversion to account for the one of the first and second currency types it is not currently accounting for in lieu of the one of the first and second currency types it is currently accounting for; a printing module which prints an indicium indicative of value, the printing module having a first indicator indicative of which of the first and second currency types the printhead module is set to print as part of the indicium; and an apparatus for determining if a first predetermined relationship exists between the first indicator, the first identifier, and the second identifier and for preventing the printing of the indicium if the predetermined relationship does not exist.

2 Claims, 3 Drawing Sheets

POSTAGE METERING SYSTEM HAVING CURRENCY COMPATIBILITY SECURITY FEATURE

BACKGROUND OF THE INVENTION

The instant invention relates to value metering systems. More particularly, the instant invention is directed to a postage metering system that ensures that the currency accounted for and the currency printed as part of a postage indicium by the postage metering system are consistent with each other.

Postage meters of both the electronic and mechanical variety have conventionally had all of the accounting and printing control structure contained in a secure single housing in order to protect against tampering. Recently, however, advances in microelectronics, digital printing, and encryption techniques have led to the design of modular postage metering systems where the postage accounting and printhead modules are designed to be easily removed at a customer's site. In these newer systems, the postage accounting vault may a portable device, such as a smart card, which can be removably inserted into a base module containing the metering system interface controls and a removable printhead module. The portable device is designed to be carried by a user for insertion into the base module whenever postage is to be dispensed and charged to that portable device. The benefits of the portable device are that multiple users can access a single base module. Alternatively, instead of individual portable devices some postage metering systems have an easily removable accounting module within the base module. The removable accounting module acts as the vault for all postage dispensed by the postage metering system in lieu of separate portable devices. However, even where a single removable accounting module is used, its easily removable design permits for its replacement in the event of, for example, a vault failure. For the purpose of this application the portable accounting devices and the removable accounting modules are collectively referred to as modular vaults.

In the modular postage metering systems described above, all of the components are easily accessible and not contained within a single secure housing. Accordingly, security is provided via encrypted communications between the various metering system modules. Moreover, it has been proposed to utilize encrypted information, which is printed together with the postage indicia for increasing security relative to fraudulently printed postage indicia. That is, the printed encrypted information on any mailpiece can be subsequently scanned and analyzed by a postal authority to determine the authenticity of the printed indicia on the selected mailpiece. Thus, while the scanning of every single mailpiece being processed may not be considered practical, random sampling of individual mailpieces would likely identify any large-scale fraudulent indicia printing operation.

The use of the above-discussed modular metering systems has provided great flexibility in postage meter system design. For example, individual accounting and printing modules can be easily replaced, if defective, without having to return the entire metering system to the postal authority. Moreover, the enhancements in encrypted security techniques have even led to the development of personal computer metering concepts where non-dedicated computer printers are used to print the postage indicia. In addition, where portable accounting devices are used, the metering system user is provided with a great deal of operational flexibility because any number of portable accounting devices can be inserted into any single base module for the purpose of printing postage. Thus, a company can have a central base module and allocate individual portable postage vaults to different departments. Since each portable vault can be controlled via software to have a postage fund limit, flexibility is provided in that individual departments can easily place postage on items to be mailed while individual accounting and postage expenses are carefully monitored in each portable vault. This same concept can also be used to locate a base module at a central location in a community, such as a convenience store. Individuals could then obtain portable vaults for use in the central base module so that postage could be applied to their mailpieces. Since the postage is prepaid for and accounted for in the individual portable vaults, the mailing of individual pieces of mail (or even a batch of mail) becomes easier for individuals without requiring them to procure or rent the entire base module.

One example of a postage metering system that uses a single removable accounting module (vault) is the E700 postage meter manufactured by Pitney Bowes Inc. The removable accounting vault accounts for all of the postage received and dispensed by the postage meter while a removable printhead module has stored therein all of the indicium graphics required for printing the postage indicium on a mailpiece. Since both the printhead module and the removable accounting vault are easily accessible, security is provided through a mutual encrypted handshake that occurs prior to the printing of the postage indicium. The handshake procedure permits the accounting vault and the printhead module to verify the authenticity of each other as approved postage metering modules. Moreover, the mutual handshake procedure is implemented in all E700 or equivalent models regardless of which country the postage meter is to be deployed. That is, postage metering systems may be deployed on a worldwide basis. Thus, the design of the postage indicium printed is subject to specification/approval by local postal authorities. While this results in the need to customize the indicium graphics for each country, the fact that a common mutual authentication handshake is used permits the easy configuration or reconfiguration of any specific postage metering system for use in any country.

It has further been proposed to have a plurality of different country indicium graphics stored in a postage metering system in order to permit the easy reconfiguration of the postage metering system between the different countries. Such a postage metering system would be useful, for example, in Europe where the Euro dollar is being introduced. That is, if the Euro dollar graphics are stored in a postage metering system currently configured to account for and print an indicium in a local currency, the conversion of that postage meter to account for Euro dollars and print a corresponding Euro dollar indicium in the future is greatly simplified.

While the modularity and commonality of postage metering designs have produced the advantages discussed above, there exists a potential security problem. That is, suppose two meters exist in a country in Europe. The first postage meter has a vault and printhead that respectively account for and print the postage indicium in the local currency. The second postage meter has been reconfigured to account for and print the indicium in Euro dollars. Also, assume for example, that due to the exchange rate, one Euro dollar is equal to 100 local currency dollars. Thus, if the printhead module of the local currency postage meter was replaced with the printhead module of the Euro dollar meter an attacker would realize a significant gain since the printed postal indicia appearing on its face to indicate one Euro dollar would only be accounted for as one local dollar.

Therefore, there is a need for a modular postage metering system that is designed for modularity, commonality and ease of reconfiguration while at the same time ensuring that currency compatibility exists between what is accounted for and what is printed.

SUMMARY OF THE INVENTION

It is an object of the invention to overcome the disadvantages of the prior art discussed above and to provide a value dispensing system which ensures currency compatibility between its accounting module and its printing module.

The above object is met by providing a value dispensing system that includes a vault that accounts for units of a currency type dispensed by the value dispensing system, the vault including a first identifier that indicates one of different first and second currency types the vault is currently accounting for and a second identifier indicative of whether the vault is pending conversion to account for the one of the first and second currency types it is not currently accounting for in lieu of the one of the first and second currency types it is currently accounting for; a printing module which prints an indicium indicative of value, the printing module having a first indicator indicative of which of the first and second currency types the printhead module is set to print as part of the indicium; and an apparatus for determining if a first predetermined relationship exists between the first indicator, the first identifier, and the second identifier and for preventing the printing of the indicium if the predetermined relationship does not exist.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
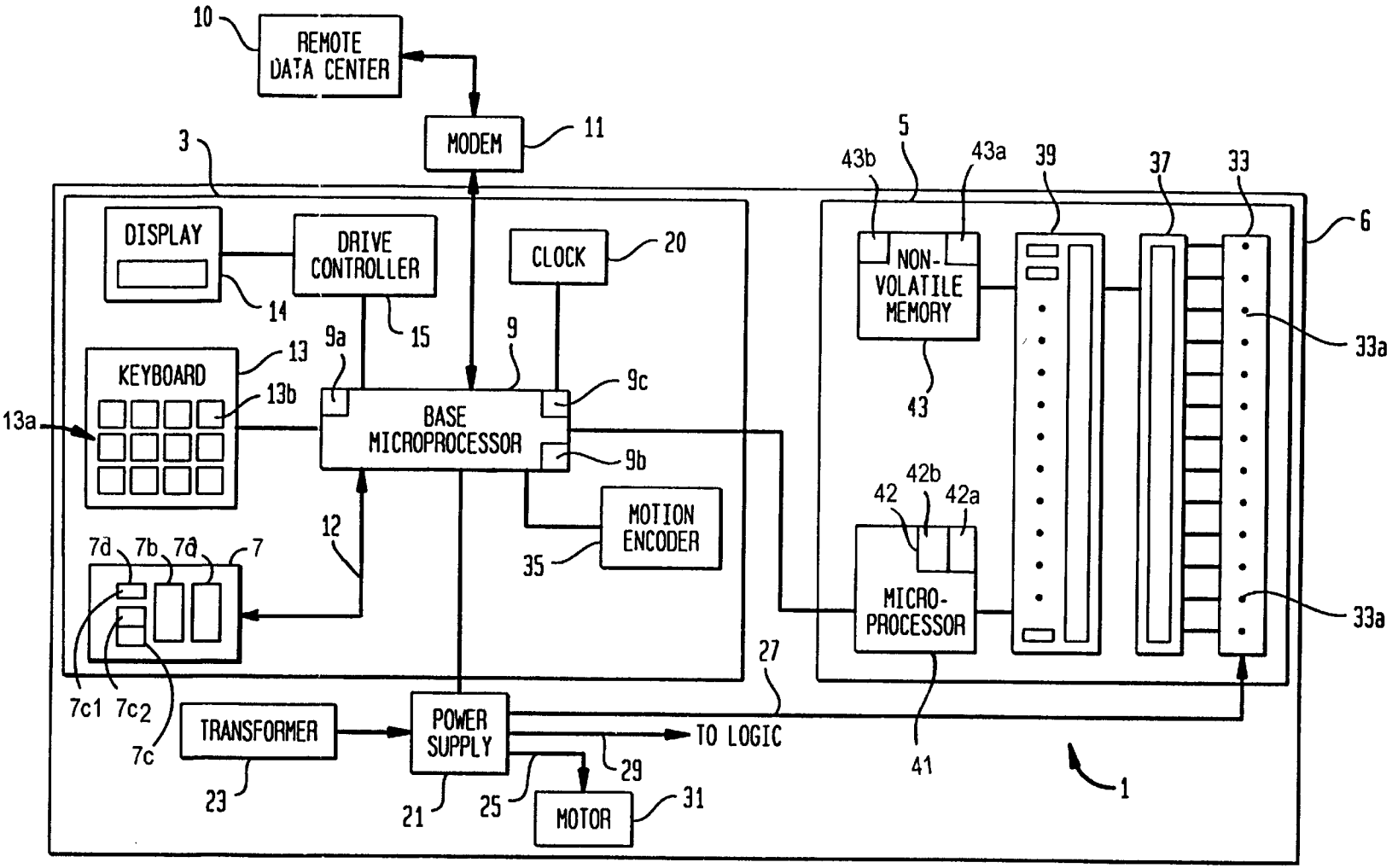
FIG. 1 is an electrical block diagram of the inventive postage metering system.

Referring to FIG. 1, a postage meter 1 includes two primary modules, a base module 3 and a printhead module 5 each of which are contained within a housing defining a single transaction terminal 6. Base module 3 includes a removable modular vault 7, and a transaction or base microprocessor 9. Removable modular vault 7 has a central processing unit 7*a,* RAM 7*b,* and non-volatile memory (NVM) 7*c* which together with the operating programs stored in ROM 7*d* allow the removable modular vault 7 to perform the accounting functions of postage meter 1. That is, removable modular vault 7 has the capability to have securely downloaded therein, from a remote data center 10, a predetermined amount of postage funds by securely communicating with data center 10 via a modem 11 and transaction microprocessor 9. Furthermore, during each postage transaction, removable modular vault 7 checks to see if sufficient funds are available. If sufficient funds are available, removable modular vault 7 debits the amount from a descending register, adds the amount to an ascending register, and sends the postage amount to the printhead module 5 via the transaction microprocessor 9. The ascending and descending registers while not shown are within NVM 7*c*. Transaction microprocessor 9 also sends date data to the printhead module 5 so that a conventional postal indicia image can be printed on a mailpiece.

Removable modular vault 7 thus manages the postage funds with the ascending register representing the lifetime amount of postage funds spent, the descending register representing the amount of funds currently available, and a control sum register representing the running total amount of funds which have been credited to removable modular vault 7. Additional features of removable modular vault 7 which can be included are a piece counter register, encryption algorithms for encoding the information sent to the printhead module 5, and software for requiring a user to input a personal identification number which must be verified by the vault microprocessor 7 prior to its authorizing a postage transaction.

Transaction microprocessor 9 acts as a traffic cop in coordinating and assisting in the transfer of information along data line 12 between the vault microprocessor 7 and the printhead module 5, as well as coordinating various support functions necessary to complete the metering function. Transaction microprocessor 9 includes RAM 9*a,* ROM 9*b,* and central processing unit 9*c* to provide for the effective execution of meter operating programs stored in ROM 9*b* to accomplish the meter coordinating functions discussed above as well as the currency conversion communications discussed hereinafter. Transaction microprocessor 9 also interacts with keyboard 13 to transfer user information input through keyboard keys 13*a* (such as PIN number, postage amount) to removable modular vault 7. Additionally, transaction microprocessor 9 sends data to a liquid crystal display 14 via a driver/controller 15 for the purpose of displaying user inputs or for prompting the user for additional inputs. A clock 20 provides date and time information to transaction microprocessor 9. Alternatively, clock 20 can be eliminated and the clock function can be accomplished by the transaction microprocessor 9.

Postage meter 1 also includes a conventional power supply 21 which conditions raw A.C. voltages from a wall mounted transformer 23 to provide the required regulated and unregulated D.C. voltages for the postage meter 1. Voltages are output via lines 25, 27, and 29 to a printhead motor 31, printhead 33 and all logic circuits. Motor 31 is used to control the movement of the printhead relative to the mailpiece upon which an indicia is to be printed. Base microprocessor 9 controls the supply of power to motor 31 to ensure the proper starting and stopping of printhead 33 movement after removable modular vault 7 authorizes a transaction.

Base module 3 also includes a motion encoder 35 that processes the movement of the printhead motor 31 so that the exact position of printhead 33 can be determined. Signals from motion encoder 35 are sent to printhead module 5 to coordinate the energizing of individual printhead elements 33*a* in printhead 33 with the positioning of printhead 33. Alternatively, motion encoder 35 can be eliminated and the pulses applied to stepper motor 31 can be counted to determine the location of printhead 33 and to coordinate energizing of printhead elements 33*a*.

Printhead module 5 includes printhead 33, a printhead driver 37, a drawing engine 39 (which can be a microprocessor or an Application Specific Integrated Circuit (ASIC)), a microprocessor 41 and a nonvolatile memory 43. NVM 43 has stored therein a first image data set 43*a* including the fixed portions of a first currency indicia (elements that do not change for each transaction) and individual first currency fonts that can be required as part of the variable data (data that may change for each transaction such as postage amount and date) of the first currency indicia that is printed. Additionally, NVM 43 includes a second image data set 43*b* that includes the fixed portions and variable data fonts used in printing a second currency indicia. Thus, by way of example, the first image data set 43*a* might be used to print a German postage indicia in the German language and showing the postage value as Deutschemarks, while the second image data set 43*b* would be used to print a postage indicia for a second national currency or even to reflect the new Euro currency in a postage indicia.

In operation, microprocessor 41 receives a print command, postage amount, and date via the transaction microprocessor 9 from vault 7. The postage amount and date are sent from microprocessor 41 to the drawing engine 39 which then accesses non-volatile memory 43 to obtain from either the first or second image data sets 43*a,* 43*b* the image data elements required to print the desired currency indicia image. The determination of which of the first and second image data sets 43*a,* 43*b* is used to print the indicia image is a function of which data set is currently set as the default data set within the postage meter 1. The image data elements obtained by the drawing engine 39 are then downloaded by the drawing engine 39 to the printhead driver 37 in order to energize individual printhead elements 33*a* to produce a single column dot pattern of the desired postage indicia. The individual column-by-column generation of the indicia is synchronized with movement of printhead 33 until the full indicia is produced.

In the preferred embodiment of the invention, the removable vault 7 simply accounts for units of value. That is, at the remote data center 10 there is a prepaid postage account associated with the particular removable vault 10 such as through the use of a unique numerical identifier associated with each vault 7. The prepaid account is established, for example, as a Deutschemark account. Thus, when the removable vault 7 is remotely refilled with postage funds in a conventional manner, the registers within vault 7 simply account for the number of units of Deutschemarks downloaded therein. When postage is subsequently dispensed by the postage meter 1 the first data set 43*a* is utilized to print a German postage indicia while the dispensed Deutschemarks are accounted for in NVM 7*c* of vault 7. As previously discussed however, if the vault 7 which corresponds to a Deutschemark account at the data center 10 is inserted into a different postage meter 1 which has designated the second image data set 43*b* to be utilized in printing the postage indicia, an inconsistency in accounting for dispensed postage occurs. That is, since the second image data set 43*b* is for a postage indicia of Euro dollars the vault 7 will account for dispensing postage in the first currency (Deutschemarks) while the printed indicia reflects the second currency (Euro dollars).

Figure 2:
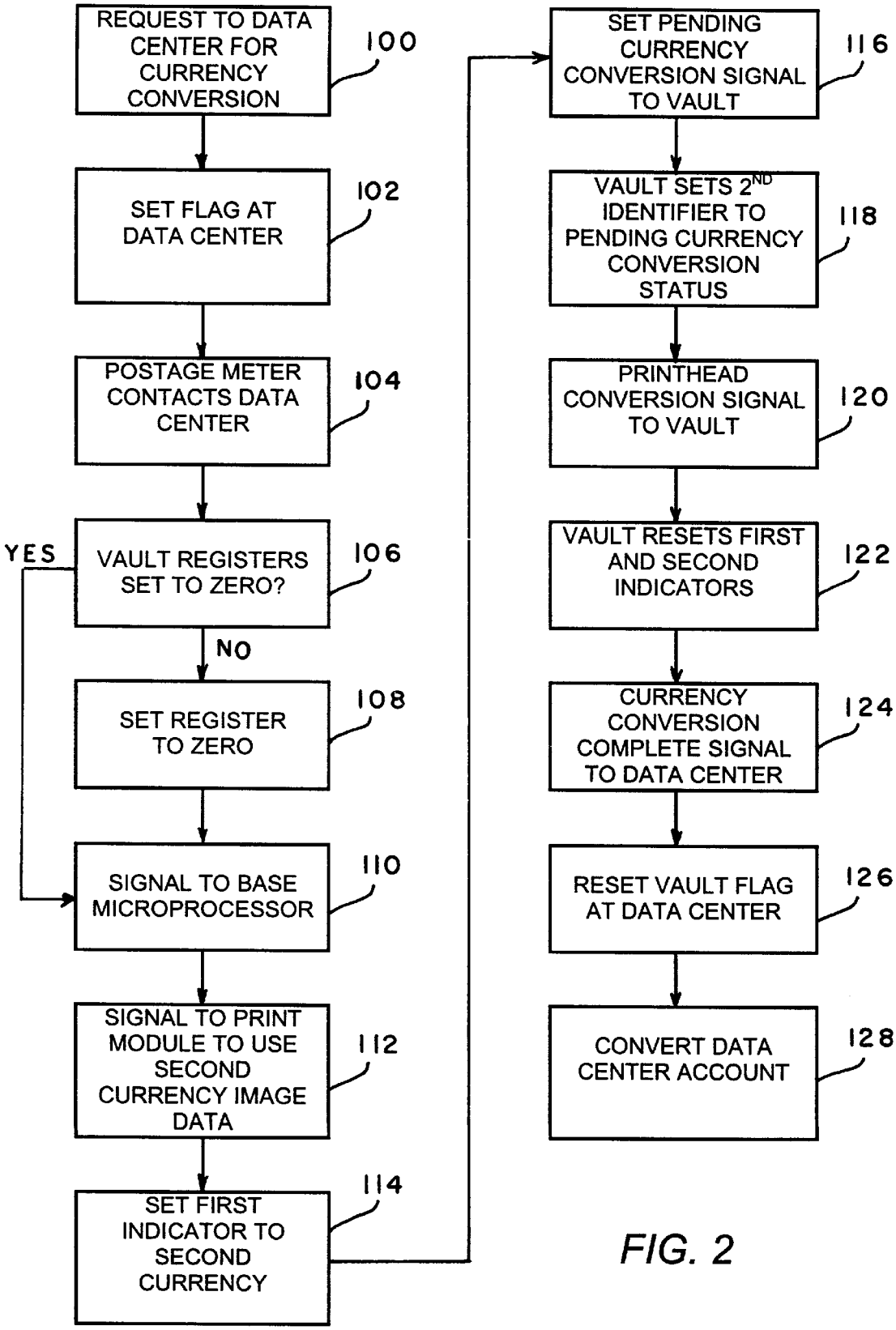
FIG. 2 is a flow chart of the process for converting the postage metering system from one currency to another currency.

The inventive postage meter 1 is designed to prevent the above situation from occurring via software as discussed immediately hereafter with reference to FIGS. 1 and 2. Printhead module microprocessor 41 includes an NVM 42 having a first indicator 42*a* (such as a flag) which is indicative as to whether the printhead module 5 is new. A second indicator 42*b* identifies whether the printhead module 5 is designated to use the first image data set 43*a* for printing the postage indicia in a first currency or the second image data set 43*b* for printing the postage indicia in a second currency. Similarly, NVM 7*c* of vault 7 includes a first identifier 7*c*1 (such as a flag) which indicates whether the vault 7 is accounting for the first or second currency and a second identifier 7*c*2 which indicates if the vault 7 is pending a currency conversion as discussed in more detail below.

The inventive postage meter 1 provides an advantage in that it can initially be shipped to a user such that it accounts for postage dispensed in the first currency and prints a corresponding first currency postage indicia and subsequently can be easily converted to perform the same functions in the second currency. Initially, the printhead module 5 first indicator 42*a* is set to identify the printhead module 5 as not being new while the second indicator 42*b* is set to identify use of the first image data set 43*a* to produce a postage indicia in the first currency. The vault 7 has the first identifier 7*c*1 set to indicate that it is accounting for the first currency in correspondence to the user account at the data center 10. Vault 7 has the second identifier 7*c*2 set to indicate that a currency conversion is not pending. In this situation, upon power up of the postage meter 1 and prior to the printing of each individual postage indicia, the base microprocessor 9 queries the vault 7 and the printhead module 5 for the first and second indicators and the first and second identifiers. In the situation where the first and second indicators and the first and second identifiers are set as just discussed, the postage meter 1 is enabled to print postage indicia.

At times, however, when the user wishes to change the postage meter 1 to account for and print a postage indicia for the second type currency a conversion process as identified in FIG. 2 must be initiated. In step 100, the user contacts the data center 10 identifying that a currency conversion for that particular vault 7 is desired. The data center sets a flag in its database to identify that such currency conversion is desired, the flag being associated with the unique vault 7 serial number (step 102). When the postage meter 1 next contacts the data center 10 via the modem 11 such as to perform a refill or inspection (step 104), the data center 10 will initiate the currency conversion process by first checking to see if the accounting registers in NVM 7*c* of vault 7 have been set to zero (step 106). As previously discussed, since the vault 7 registers only account for units of value, they must be set to zero to initiate accounting for the new currency to be used. If the answer at step 106 is NO, the zeroing out of the accounting registers can be done remotely by the data center 10 such as by using a funds withdrawal process as is known in the art (step 108). Once the registers have been set to zero or in the event that the answer at step 106 is YES, the data center 10 conveys such status to the base microprocessor 9 (step 110). Base microprocessor 9 sends a message to microprocessor 41 directing the microprocessor 41 to now use the second image data set 43*b* for printing postage (step 112). Microprocessor 41 in turn directs the print engine 39 to utilize the second image data set 43*b* and sets the first indicator 42*a* to identify that the second currency image data set 43*b* is to be used for printing the postage indicia. The base microprocessor 9 also sends a pending conversion message to vault 7 which indicates to the vault that the printhead module 5 is currently converting to use the second currency image data set 43*b* (step 116). Upon receipt of this signal, the vault 7 changes the second identifier 7*c*2 to a pending currency conversion status (step 118). In the event that the printhead module 5 currency conversion is successfully completed, the microprocessor 41 sends a return signal to base microprocessor 9 indicative that such is the case (step 120). Base microprocessor 9 then sends a printhead module 5 conversion completed signal to vault 7 which changes the second identifier 7*c*2 to reflect that a currency is no longer pending and changes the first identifier 7*c*1 to reflect that the vault 7 is now accounting for the second currency (step 122). Upon completion of the resetting of the vault indicators 7*c*1, 7*c*2, the vault 7 signals the base microprocessor 9 that such resetting has occurred and a corresponding signal is sent to the data center 10 to identify completion of the currency conversion in the postage meter 1 (step 124). The data center 10 then resets the currency conversion flag that previously was set at the data center 210 for the vault 7 (step 126). The data center 10 then converts the currently stored first currency in the account into a corresponding second currency amount taking into account the appropriate exchange rates (128). At this point in time the postage meter vault 7 and printhead module 5, and the data center 10 are in synchronization with respect to using the second currency in performing their respective functions. It is to be noted that the account conversion of step 128 can alternatively be accomplished prior to the data center 10 initiating the currency conversion in the postage meter 1.

Figure 3:
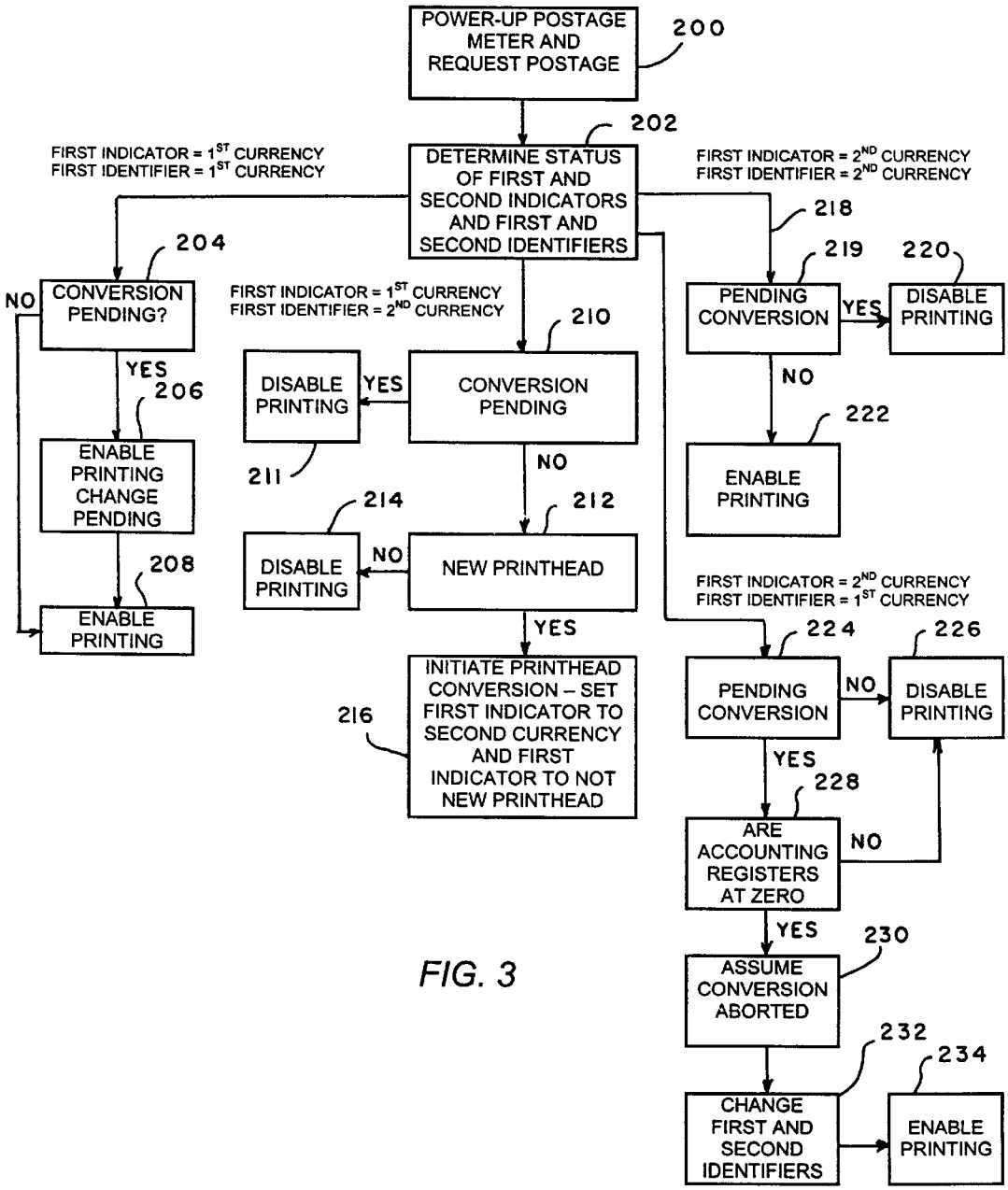
FIG. 3 is a flow chart of the postage metering system currency compatibility security routine.

In order to fully understand the checks and balances of the indicators 42*a*, 42*b* and the identifiers 7*c*1, 7*c*2, reference is made to FIG. 3. At power up and prior to printing a requested postage indicia (step 200), base microprocessor 9 queries vault 7 as to the status of its first and second identifiers 7*c*1, 7*c*2 and microprocessor 41 as to the status of its first and second indicators 42*a*, 42*b* (step 202). If the first indicator 42*a* of the printhead module 5 and the first identifier 7*c*1 of vault 7 are both set to indicate the first currency, the process moves to step 204 where the second identifier 7*c*2 reflects whether or not a currency conversion is pending. If the answer at step 204 is YES, printing of postage indicia is enabled and the second identifier 7*c*2 is changed to a non-pending currency conversion state (step 206). This situation assumes that it is possible that a currency conversion of the printhead module 5 was aborted (i.e. loss of power) and therefore resets the postage meter 1 to the default mode that is the first currency state. On the other hand if the answer at step 204 is NO, printing of postage indicia is enabled (step 208).

Returning to step 202, if the answer to the query is that the first indicator 42*a* reflects the first currency while the first identifier 7*c*1 reflects the second currency the base module 9 determines if a conversion is pending at step 210 based on the second identifier 7*c*2. If a conversion is pending, this indicates a mismatch between the currency status of the printhead module 5 and the vault 7 and printing is disabled at step 211. Furthermore, this situation is unacceptable because any vault 7 which is accounting for the second currency should not have a second identifier 7*c*2 indicating that a currency conversion is pending since the conversion has already been completed. However, if the answer at step 210 is NO, base microprocessor 9 determines via the status of second indicator 42*b* if a new printhead module 5 has been installed (step 212). In the event that the printhead module 5 is not a new printhead printing is disabled at step 214 due to the currency mismatch between the printhead module 5 and vault 7. However, if the printhead module 5 is new, the base module microprocessor 9 recognizes this situation and directs the printhead module 5 to convert to the second currency and to change the status of the first and second indicators 42*a*, 42*b* to reflect the second currency and a not new printhead status respectively (step 216). This permits the replacement of a defective printhead module 5 with an authorized new printhead module 5.

Returning to step 202, if the first identifier 42*a* and first indicator 7*c*1 both reflect the second currency status, the base microprocessor 9 determines if a currency conversion is pending at step 219. If the answer at step 219 is YES, printing is disabled (step 220) since a vault 7 should not reflect a currency pending status if it is accounting for the second currency since the conversion has already been completed. If however the answer at step 219 is NO, printing is enabled since a proper postage meter currency conversion process has been completed to change the postage meter 1 from accounting for and printing the first currency to accounting for and printing the second currency.

Returning once again to step 202, if the first indicator 42*a* reflects the second currency and the first identifier 7*c*1 reflects the first currency the base microprocessor determines at step 224 if a conversion is pending. If the answer is NO, there is a currency mismatch and printing is disabled at step 226. If the answer at step 224 is YES, the base microprocessor 9 queries the vault 7 to determine if the accounting registers (at least the descending register) is at zero (step 228). If the answer at step 228 is NO, printing is disabled (step 226). However, if the answer at step 228 is YES, the base microprocessor 9 assumes that a currency conversion was aborted after the printhead module 5 converted but prior to the vault 7 receiving notification of such conversion (step 230). Accordingly, the vault 7 changes the status of its first and second identifiers to respectively reflect the second currency and the non-pending status (step 232) and printing is enabled (step 234).

While the above description of the preferred embodiment highlights the advantages of the instant invention, additional advantages and modifications will readily occur to those skilled in the art. Therefore, the invention in its broader aspects is not limited to the specific details and representative devices, shown and described herein. Accordingly, various modifications may be made without departing from the spirit or scope of the general inventive concept as defined by the appended claims.

What is claimed is:

1. A value dispensing system comprising:

a vault that accounts for units of a currency type dispensed by the value dispensing system, the vault including a first identifier that indicates one of different first and second currency types the vault is currently accounting for and a second identifier indicative of whether the vault is pending conversion to account for the one of the first and second currency types it is not currently accounting for in lieu of the one of the first and second currency types it is currently accounting for;

a printing module which prints an indicium indicative of value, the printing module having a first indicator indicative of which of the first and second currency types the printhead module is set to print as part of the indicium; and means for determining if a first predetermined relationship exists between the first indicator, the first identifier, and the second identifier and for preventing the printing of the indicium if the predetermined relationship does not exist.

2. A value dispensing system as recited in claim 1, wherein the printing module further includes a second indicator indicative of whether the printing module is new and the means for determining prevents the printing of the indicium if a second predetermined relationship between the first indicator, the second indicator, the first identifier, and the second identifier does not exist.

* * * * *